United States Patent [19]

Tsugaki et al.

[11] Patent Number: 4,667,543

[45] Date of Patent: May 26, 1987

[54] METHOD OF MANUFACTURING A ROCK BIT CONE

[75] Inventors: Shoichiro Tsugaki, Tokyo; Tomoo Miyasaka, Funabashi; Yukio Nishiyama; Toshio Atsuta, both of Akashi, all of Japan

[73] Assignee: Kawasaki Jukogyo Kabushiki Kaisha, Japan

[21] Appl. No.: 861,077

[22] Filed: May 8, 1986

[30] Foreign Application Priority Data

Oct. 7, 1983 [JP] Japan ..... 58-186852
Oct. 7, 1983 [JP] Japan ..... 58-186853
Oct. 7, 1983 [JP] Japan ..... 58-186854

[51] Int. Cl.[4] ..... B21K 5/02; B22C 9/04; B22D 19/00

[52] U.S. Cl. ..... 76/108 A; 164/97

[58] Field of Search ..... 76/108 R, 108 A, 101 E, 76/101 R, 101 A; 164/97, 98, 95, 99, 114, 129, 130, 290; 175/410, 374

[56] References Cited

U.S. PATENT DOCUMENTS

| | | | |
|---|---|---|---|
| 1,043,831 | 11/1912 | Heinkel et al. | 76/101 A |
| 2,125,332 | 8/1938 | Bursell | 76/101 A |
| 2,184,776 | 12/1939 | Cottrell | 76/108 R |
| 2,260,593 | 10/1941 | Wittlinger | 76/101 A |
| 2,442,718 | 6/1948 | Woock | 164/290 |
| 2,740,176 | 4/1956 | Duval | 164/290 |
| 2,743,495 | 5/1956 | Eklund | 175/410 |
| 4,276,788 | 7/1981 | Van Nederveen | 76/108 A |
| 4,396,077 | 8/1983 | Radtke | 175/393 |
| 4,423,646 | 1/1984 | Bernhardt | 76/108 R |

*Primary Examiner*—Roscoe V. Parker

[57] ABSTRACT

A method of manufacturing a rock bit cone having a substantially conical body on a surface of which a number of teeth are formed is manufactured by pressure-casting with using a casting mold having a molding surface including a cone body defining surface portion and tooth defining surface portions, pouring a molten metal of very hard and low melting point alloy having a melting point of 1040°-1120° C. and Rockwell hardness of 55-65 to the casting mold to centrifugal-cast at least a predetermined area including a tip of each tooth with the hard metal, and pouring a molten tough metal to the casting mold to centrifugal-cast the cone body.

2 Claims, 12 Drawing Figures

METHOD OF MANUFACTURING A ROCK BIT CONE

This is a continuation-in-part of U.S. application Ser. No. 657,603 filed Oct. 4, 1984.

BACKGROUND OF THE INVENTION

The present invention relates to a method of manufacturing a rock bit cone rotatably supported by each of a plurality of bearing pins extending centripetally obliquely equiangularly from a rock bit body and having a number of teeth on a conical outer surface thereof.

Petroleum and natural gas exist, generally beneath a cap rock. Therefore, in order to prospect for them and to mine them, it is necessary to drill a rock layer by using a drilling facility provided on the ground or sea surface.

As the rock bit for drilling rock layer, blade bit, cone bit and diamond bit etc. have been known. Among others, the cone bit has been widely used.

The conventional cone bit comprises a rock bit body formed in an upper portion thereof with a thread into which a drill collar of a drill pipe is screwed, a plurality of equiangularly spaced bearing pins extending centripetally obliquely from an inner face of a leg portion formed in a lower portion thereof. Each bearing pin supports rotatably a cutter in the form of a cone having a conical outer surface in which a number of teeth are implanted.

In drilling a rock layer, a drill collar mounted on a lower end of a drill pipe is screwed onto the threaded portion of the bit body and the drill pipe is rotated by a rotary table of a drilling rig arranged on the ground or sea surface, so that the cones are rotated around the bearing pins by means of contacts between the teeth thereof and the rock layer. Thus, portions of the rock layer are crushed, turned up and kicked out by the teeth. On the other hand, high pressure mud is supplied through the drill pipe to the cone bit by a mud pump provided in the drilling rig. The high pressure mud functions to lubricate the teeth of the cones and carry the crushed rock portions through an annular space formed between an outer surface of the drill pipe and a wall of a drilled hole up to the surface of ground or sea.

Therefore, the teeth must be of highly hard material. A TCI (tungsten carbide insert) bit having implanted inserts each of tungsten carbide or a milled tooth bit having teeth each prepared by machining and then hard-facing the surface thereof with a hard metal has been used conventionally. The TCI bit is usually manufactured by forming a cone body by forging, boring holes in places of a surface thereof, in which cylindrical inserts are to be implanted, by a boring machine and pressing these inserts into the respective holes. Therefore, it requires a number of manhours and it becomes very expensive, necessarily. On the other hand, the hard-facing technique which is necessary to manufacture the milled tooth bit usually contains some uncertainty and it is very difficult to obtain a uniform hard metal layer on the teeth. Even if a uniform layer is provided, it is usually peeled off easily by mechanical shock. Further, the milled tooth bit is also expensive.

SUMMARY OF THE INVENTION

An object of the present invention is to provide a method of manufacturing a cone which is stable in performance and inexpensive.

According to one aspect of the present invention, the above object is achieved by pressure-casting of a cone body having teeth by using a casting mold having a molding surface configuration including a cone body portion and tooth portions and machining only a portion thereof to be supported by a bearing pin.

According to another aspect of the present invention, the above object is achieved by the pressure-casting using a similar mold to that used in the first aspect except that preliminary prepared inserts of highly hard alloy such as tungsten carbide are positioned in desired places on the molding surface such that when cast, a cone has the inserts having root portions embedded in the cone body.

According to a third aspect of the present invention, the same casting mold as that used in the first method is used. A molten metal of very hard and low melting point alloy having a melting point of 1040°-300° C. and Rockwell C hardness of 40-66 is firstly poured thereinto and by pressure-casting method to form a hard metal portions on at least tip portions of the teeth, and then a molten tough metal is poured and by pressure-casting method so that the second metal is adhered firmly to the first metal to form a cone body of the tough metal having teeth at least the end portions of which are formed of the hard metal.

According to a fourth aspect of the present invention, a similar casting mold to that used in the first method is used. Tooth pieces of same material as the tough metal forming a cone body are preliminary prepared and are supported in recesses on an inner surface of the mold which correspond to the teeth, respectively, such that root portions of the tooth pieces protrude from the inner surface of the mold and a predetermined space is provided between a surface of each recess and an outer surface of the tooth piece. Then, a molten metal of very hard and low melting point alloy having a melting point of 1040°-1300° C. and Rockwell C hardness of 40-66 is poured into the mold by pressure-casting method so that the hard metal fills the predetermined space. Finally, the molten tough metal is poured thereinto by pressure-casting method to form the cone body. According to this fourth method, the cone body molded has the teeth which are covered by the hard metal.

According to the first method, it is possible to cast the cone body and the teeth simultaneously and, particularly, the teeth which function to crush and turn-up a rock can be formed precisely and rigidly with a minimum number of manhours comparing with the conventional method. Therefore, it is possible to provide a required preformance and strength of the cone bit. Further, since the cone body and the teeth are integral completely, there is no peeling off problem and/or dropping-out problem of the teeth. When the surface of the teeth are hardfaced on demand, there is no need of machine cutting of the teeth having complicated configuration which is necessary in producing the conventional milled tooth bit.

According to the second method of the present invention, the cone body having a precise configuration is easily produced with the root portions of the inserts being firmly embedded in the cone body. Therefore, the TCI bit can be manufactured easily comparing with the conventional method, with the inserts being retained reliably by the cone bit. The reliability of retaining the inserts may be further improved by shaping each insert such that the root portion thereof provides a means to increase a resistance against a pulling-out force applied thereto.

According to the third method, the hard metal layer is formed on a predetermined area of the insert including the top end thereof and this layer is adhered reliably to the root portions of the teeth casted integrally with the cone body.

According to the fourth method of the present invention, a predetermined surface area of each of the teeth protruding from the surface of the cone body is completely covered with the hard metal longer and the root portion of the tooth piece constituting a core of the tooth is completely integral with the cone body. Therefore, a resultant rock bit cone is excellent in strength and performance.

DETAILED DESCRIPTION OF THE PREFERRED EMBODIMENTS

Figure 1:
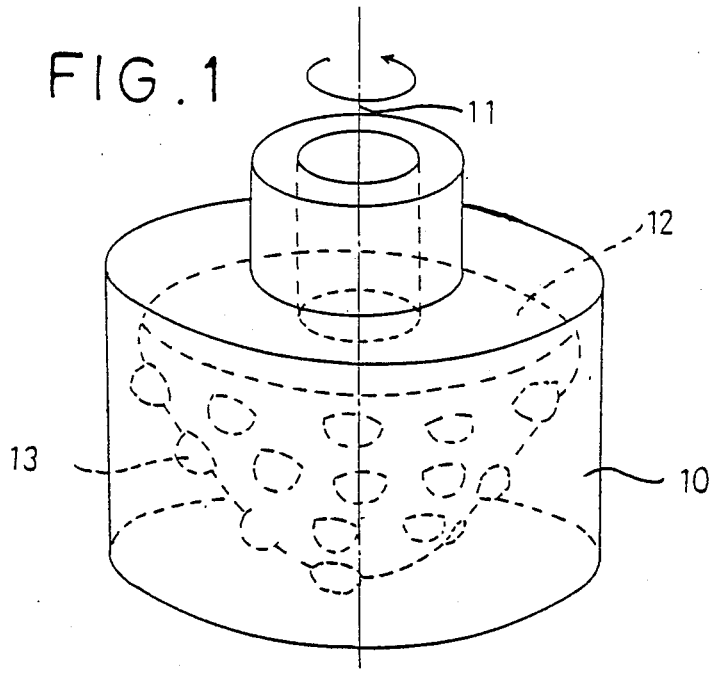
FIG. 1 is a perspective view of a casting mold to be used in performing an embodiment of the method according to the present invention.
Figure 5:
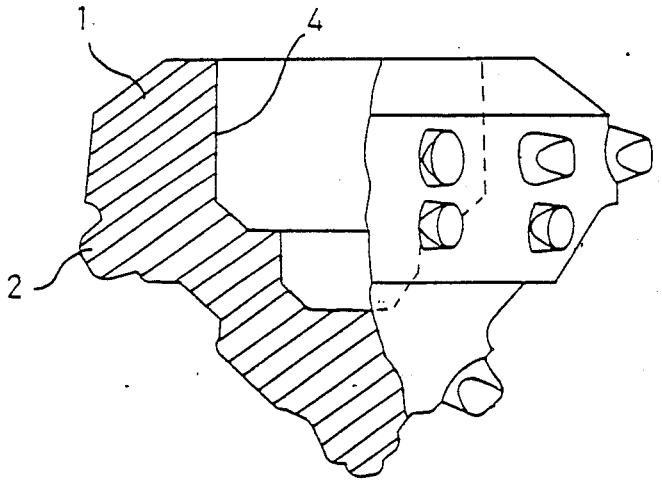
FIG. 5 is a partially cross sectioned side view of a cone manufactured according to the first method of the present invention.

FIG. 1 shows an example of a casting mold for performing the present invention. In FIG. 1, a centrifugal casting mold 10 has a molding surface composed of a cone body defining surface portion 12 and teeth defining surface portions 13. The mold 10 is rotatably supported around an axis 11 of the cone with an apex of the cone body defining surface portion being down. The casting is performed by pouring molten metal thereinto while rotating it at a suitable speed. The rotating speed should be selected such that an optimum pressing force is obtained according to a balance between a centrifugal force and gravity. With a proper selection of the rotating speed, the molten metal fills a necessary space including the teeth defining portions 13 completely and is solidified while being pressed against the molding surface by the centrifugal force, resulting in a cone body constituted with dense metal layers having integral teeth 2 on an outer surface thereof as shown in FIG. 5. Since the centrifugal force produced around the vicinity of the axis 11 is small, the density of metal portion around the shaft may be low. However, that portion is removed by machining to form a recess for receiving a bearing portion 4 for a bearing pin.

Figure 2:
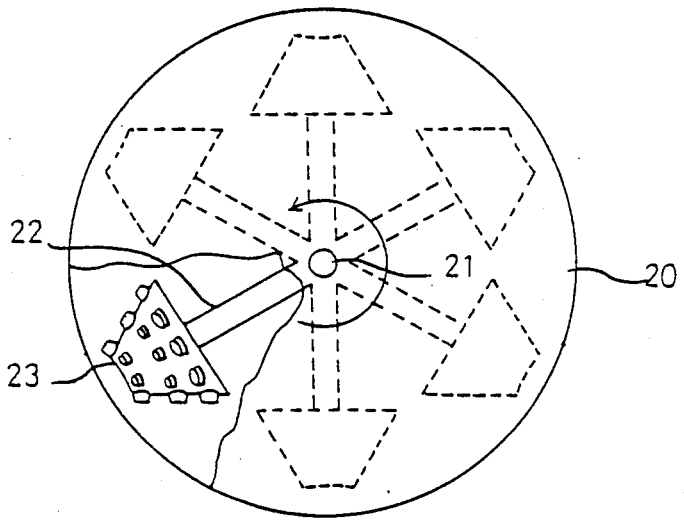
FIG. 2 is a cross sectional plane view of a portion of another example of the casting mold.

FIG. 2 shows another apparatus for performing the present method. In this apparatus, a centrifugal casting mold 20 has a plurality of pouring passages 22 extending radially from a rotation center 21 and a corresponding number of cone casting molds 23 connected to outer ends of the pouring passages, respectively, with axis of the molds 23 being matched with axis of the passages 22, respectively. Each of the cone casting mo1ds 23 has the same molding surface as that of the mold in FIG. 1. A pouring gate is connected to the rotation center 21.

By pouring molten metal to the rotation center 21 while rotating the mold 20 at a high speed, the molten metal is pressure-injected through the passages 22 to the cone molds 23, as a result of which a plurality of cones each having the configuration shown in FIG. 5 can be obtained simultaneously. When a permanent type mold such as metal mold is used as the mold 10 or 23, the manhour of preparing sand-moldings may be eliminated for subsequent moldings.

It may be possible to hard-face the teeth of the cone thus manufactured. In such case, there is no need of machine cutting of the teeth having complicated configuration, which is necessary for the conventional milled tooth bit. Therefore, it is possible to substantially reduce the number of manufacturing steps.

Figure 3:
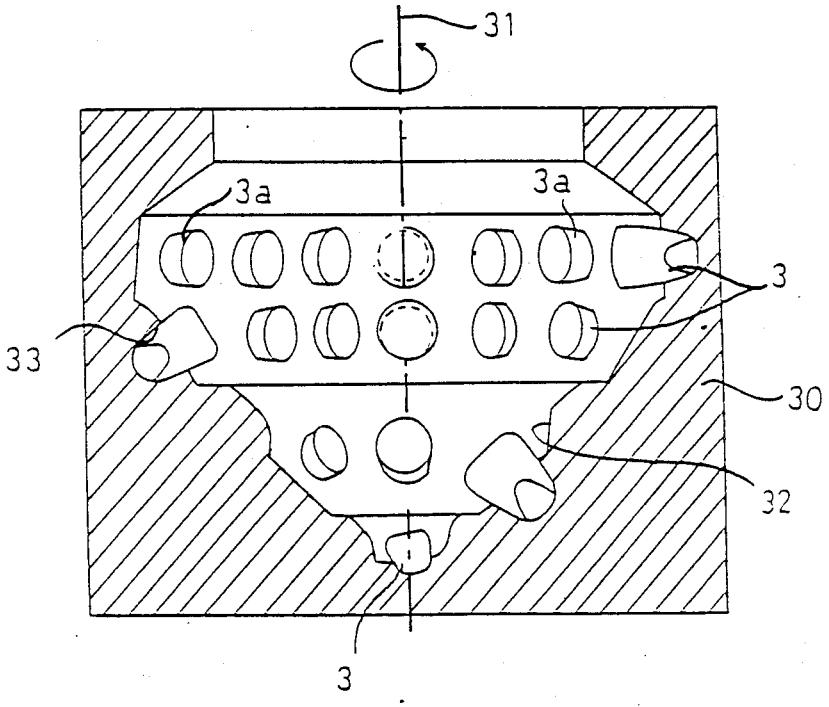
FIG. 3 is a cross sectional view of a casting mold to be used in a second embodiment of the method according to the present invention.

FIG. 3 is a vertical cross section of a casting mold to be used in performing the second method of the present invention. In FIG. 3, a casting mold 30 has a molding surface 32 composed of a cone defining surface portion and teeth defining surface portions and the molding is performed by pouring a molten metal while rotating it around an axis 31 of the mold.

Figure 6:
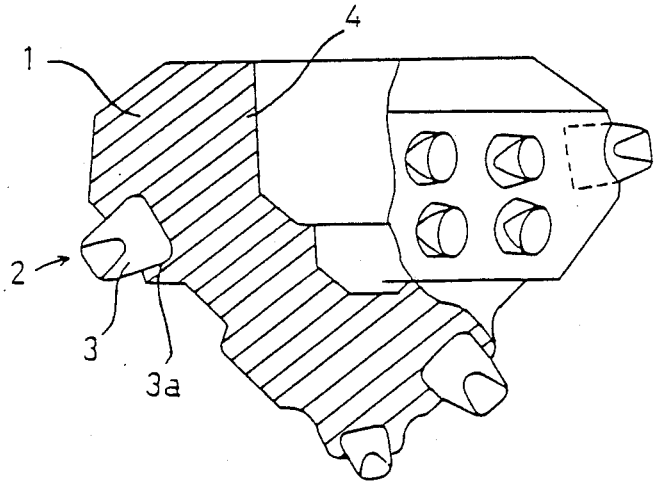
FIG. 6 is a partially cross sectioned side view of a cone manufactured according to the second method of the present invention.

In manufacturing a cone with using the mold 30, inserts 3 of highly hard alloy such as tungsten carbide which form the teeth 2 are preliminarily prepared and disposed in recesses 33 of the mold 30 corresponding to the teeth 2, respectively, with the inserts being supported such that root portions 3*a* thereof are protruded inwardly of the cone defining surface 32 of the mold 30. The centrifugal molding is performed thereafter as in the previous case. Therefore, the root portions 3*a* of the inserts 3 are embedded in the cone body 1 as shown in FIG. 6. In this case, the molten metal is forced to the surface 32 and outer surface of the root portions 3*a* of the inserts 3 and solidified under centrifugal force, the inserts 3 are reliably supported by the cone body 1 having its surface defined by the cone defining surface 32.

When the root portion 3*a* of the insert 3 is shaped effectively to prevent a drop out thereof from the cone body, the reliability of insert holding is improved.

The machining of a hole 4 for arranging the bearing portion after molded can be performed in the same way as in the previous embodiment.

Figure 4A:
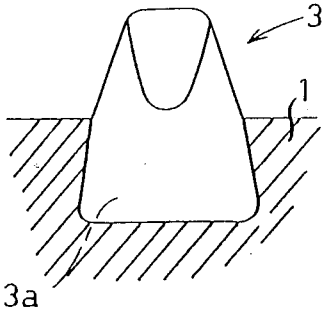
FIG. 4*a* to 4*e* show side views of inserts which have root configurations effective to prevent the inserts from dropping out, respectively.
Figure 4B:
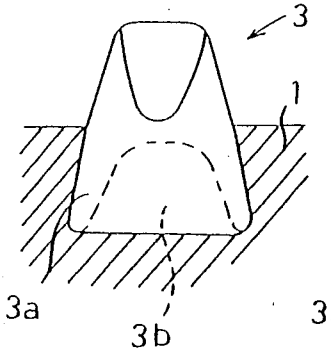
Figure 4C:
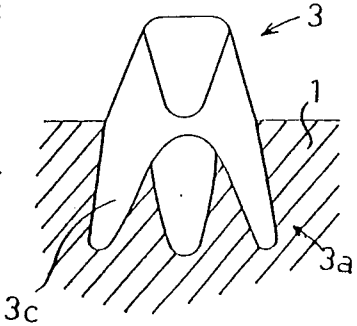
Figure 4D:
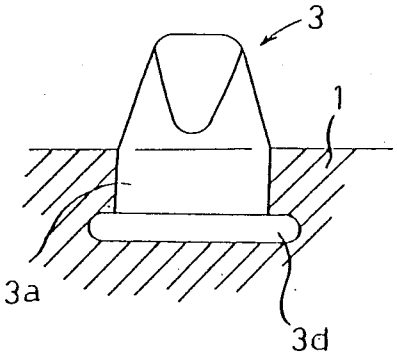
Figure 4E:
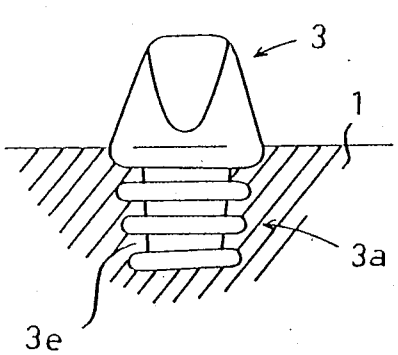

FIGS. 4*a* to 4*e* show examples of the root portion 3*a* of the insert 3, which may improve the reliability of insert holding effect of the cone body, respectively. In FIG. 4*a*, the insert 3 takes on a conical form having an expanded root portion 3*a*. In FIG. 4*b*, the insert 3 is similar in shape to the insert in FIG. 4*a*, except that a lower end face thereof is recessed as shown by 3*b*. Since the highly hard alloy forming the insert 3 is expensive, the example shown in FIG. 4*b* is advantageous economically. In FIG. 4*c*, a wall portion of the root portion 3*a* of the insert 3 in FIG. 4*b* which is defined by the recess 3*b*, is cut away partially to form a plurality of legs 3*c*. This example is more advantageous economically than the example in FIG. 4*b*. In FIG. 4*d*, the root portions 3*a* of the insert 3 is formed with a flange 3*d* and, in FIG. 4*e*, the root portion 3*a* is formed with a plurality of annular grooves 3*e*. The corner portions of root portion 3*a* are rounded in order to prevent crackings of their material.

The shape of the root portion of the insert may be any according to the mold of insert. Since the root portion of the insert is embedded in the cone body during the molding thereof with molten metal, the insert can be fixedly secured to the cone body even if the root portion thereof has a complicated shape.

Although the centrifugal casting has been described in molding the cone with molten metal, any other pressure-casting method such as die-casting can be used for this purpose. In such case, when a metal mold is used it is possible to cool casted metal rapidly. This is effective to prevent minute gaps between outer surfaces of the root portions of the inserts and the cone body from being produced due to shrinkage of metal during a cooling period.

Figure 7:
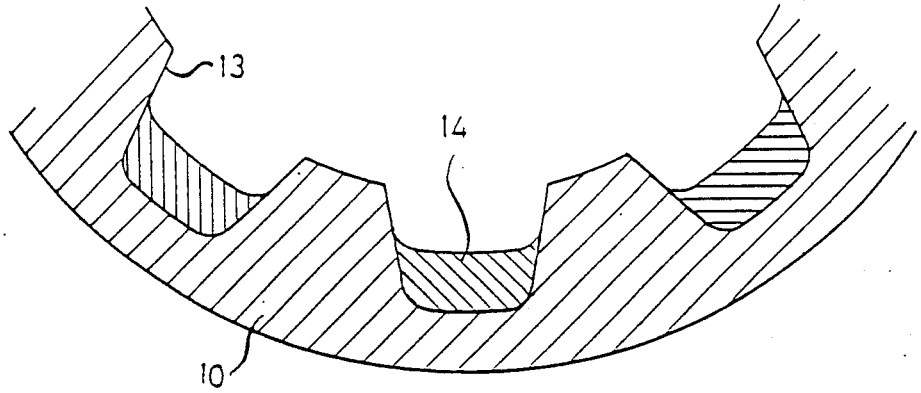
FIG. 7 is a cross section of a portion of the casting mold for explanation of the third method of the present invention.

It is now described the third method of the present invention with reference to FIG. 7. In FIG. 7, when a molten metal of very hard and low melting point alloy, such as Stellite (trade mark of Cabot Corp.) alloy etc. which are ordinarily utilized for hard facing or metal spraying, having a melting point of 1040°–1300° C. and Rockwell C hardness of 40–66, is poured into a casting mold such as a mold 10 having a molding surface portions as shown in FIG. 1 and a centrifugal molding is performed, the molten metal 14 pressingly fills the teeth portions 13 of the mold 10 and solidified inwardly from portions thereof which are in contact with the surface of the mold. When a molten tough metal for the cone body is poured before the hard metal is not completely solidified, the molten tough metal is urged to a portion of the hard metal in the tooth defining portion 13 which is separated from the surface of the portion 13 and not solidified yet, by the centrifugal force and the tough metal and the hard metal are metallurgically integrated together with and solidified. Thus, a cone having teeth each of which a hard metal cover layer having a predetermined thickness measured from the tip of the tooth.

Figure 8:
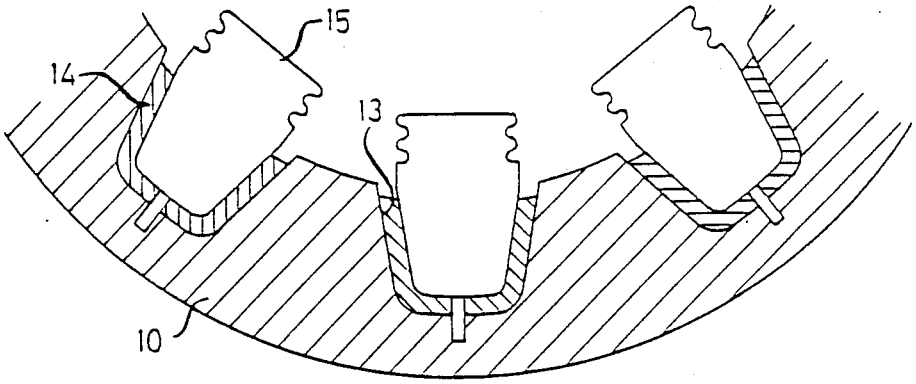
FIG. 8 is a cross section of a portion of the casting mold for explanation of the fourth method of the present invention.

Describing the fourth method of the present invention with reference to FIG. 8, a tooth piece 15 is suitably supported in each of a molding surface 13 of a casting mold 10, which corresponds to a tooth, such that there is a gap between an outer surface of the tooth piece 15 and the molding surface 13 and the tooth piece 15 protrudes slightly from a molding surface of the casting mold 10, which corresponds to a surface of a cone body. The tooth piece 15 is of a tough metal similar to a cone body material.

Then, a predetermined amount of molten metal of aforesaid very hard and low melting point alloy 14 is poured into the mold 10 and a centrifugal casting is performed. The hard metal 14 fills the gap between the tooth piece 15 and the mold surface 13 and is solidified. Then, a centrifugal casting of the cone body is performed by pouring the molten tough metal into the mold 10. During the casting of the cone body, the root portions of the tooth pieces 15 which protrude from the milding surface of the cone body are surrounded by the molten metal and melted together and then solidified. As a result, a drill bit cone is obtained which has teeth whose portions protruding outwardly from the cone body defining surface are covered completely with the hard metal and having a core, i.e., the tooth pieces 15 whose portions protruding inwardly from the cone body defining surface are integrated completely with the cone body and which is superior in mechanical strength and performance.

In the third and fourth methods of the present invention described as above, the centrifugal casting apparatus to be used is not limited to that shown in FIG. 1. Instead thereof, it may be possible to use the apparatus shown in FIG. 2 or other pressure casting apparatus than the centrifugal type may be used.

What is claimed is:

1. A method of manufacturing a rock bit cone of the type which comprises a substantially conical body and a number of teeth formed on a surface of the conical body and each covered by a hard metal layer and which is rotatably supported by each of a plurality of bearing pins extending centripetally obliquely from a drill bit body, an axis of the conical body being registered with an axis of the bearing pin, comprising the steps of preparing a casting mold having a molding surface including a cone body defining surface portion and tooth defining surface portions, pouring a molten metal of very hard and low melting point alloy having a melting point of 1040°–1120° C. and Rockwell C hardness of 55–65 to the casting mold to centrifugal-cast at least a predetermined area including a tip of each tooth with the hard metal, and pouring a molten tough metal to the casting mold to centrifugal-cast the cone body.

2. A method of manufactuing a rock bit cone of the type which has a substantially conical body on a surface of which a number of teeth each covered by a hard metal layer are formed, comprising the steps of preparing a casting mold having a molding surface including a cone body defining surface portion and tooth defining surface portions, preparing tooth pieces of the same material as that forming the cone body, disposing the tooth pieces on the tooth defining surface portions, respectively, with a predetermined gap being provided between an outer surface of each tooth piece and corresponding tooth defining surface portion and with a root portion of each tooth piece being inside the cone defining surface portion, pouring a molten metal of very hard and low melting point alloy having a melting point of 1040°–1120° C. and Rockwell C hardness of 55–65 to centrifugal-cast the gaps and pouring a molten tough metal to centrifugal-cast the cone body.

* * * * *